US006108845A

United States Patent [19]

Hung et al.

[11] Patent Number: 6,108,845

[45] Date of Patent: Aug. 29, 2000

[54] TOOL COMBINATION HAVING DETACHABLE HANDLE

[76] Inventors: Shen Chi Hung, No. 53, Dong San Road, Ching Shui Town, Taichung Hsien; Fu Daul Chen, 4F., No. 3, Ave. 17, Lane 300, Sec. 4, Jen Ai Road, Taipei, both of Taiwan

[21] Appl. No.: 09/247,103

[22] Filed: Feb. 8, 1999

[51] Int. Cl.[7] ..... B25B 7/22

[52] U.S. Cl. ..... 7/128; 30/260; 81/427.5

[58] Field of Search ..... 7/128, 125, 127, 7/158; 81/427.5, 415; 30/260, 236

[56] References Cited

U.S. PATENT DOCUMENTS 4,114,216 9/1978 Gatby ..... 7/116

5,430,941 7/1995 Lin ..... 30/260

FOREIGN PATENT DOCUMENTS 2649 350 1/1991 France ..... 7/127

*Primary Examiner*—James G. Smith
*Assistant Examiner*—Hadi Shakeri
*Attorney, Agent, or Firm*—Charles E. Baxley, Esq.

[57] ABSTRACT

A tool includes one or more tool members each having two tool elements pivotally coupled together. One or two handles each includes one end pivotally coupled to the block at a pivot pin and each includes a latch device for securing the handle to one end extension of the tool elements. The extensions of the tool elements each has a spring-biased projection for positioning the extension of the tool elements to the block. The blocks each has a shoulder for limiting the rotational movement of the handle relative to the block.

6 Claims, 7 Drawing Sheets

TOOL COMBINATION HAVING DETACHABLE HANDLE

BACKGROUND OF THE INVENTION

1. Field of the Invention

The present invention relates to a tool, and more particularly to a tool combination having an adjustable handle.

2. Description of the Prior Art

Typical plier tools or shear tools comprise a pair beams pivotally secured together and having a tool member formed on one end and a handle formed on the other end for actuating the tool members toward each other. However, the handles may not be detached from the tool members such that the tool members and/or the handles may not be replaced or adjusted with each other.

The present invention has arisen to mitigate and/or obviate the afore-described disadvantages of the conventional tools.

SUMMARY OF THE INVENTION

The primary objective of the present invention is to provide a tool combination including a pair of handles that may be detached from the tool members for changing the handles and/or the tool members.

In accordance with one aspect of the invention, there is provided a tool combination comprising a tool member including a pair of tool elements pivotally coupled together at a pivot shaft, at least one of the tool elements including an extension, at least one block including an orifice for receiving the extension of the tool elements, at least one handle including a first end pivotally coupled to the block at a pivot pin, and means for securing the handle to the extension of the tool elements.

The handle includes a latch means for securing the handle to the extension of the tool elements. The extension of the tool elements includes a depression formed therein, the handle includes a latch extended inward of the first end thereof for engaging into the depression of the extension and for securing the handle to the extension of the tool elements.

The extension of the tool elements includes a notch formed therein for defining a leg and for receiving the pivot pin. A positioning means is further provided for positioning the extension of the tool elements to the block. A limiting means is further provided for limiting a rotational movement of the handle relative to the block.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
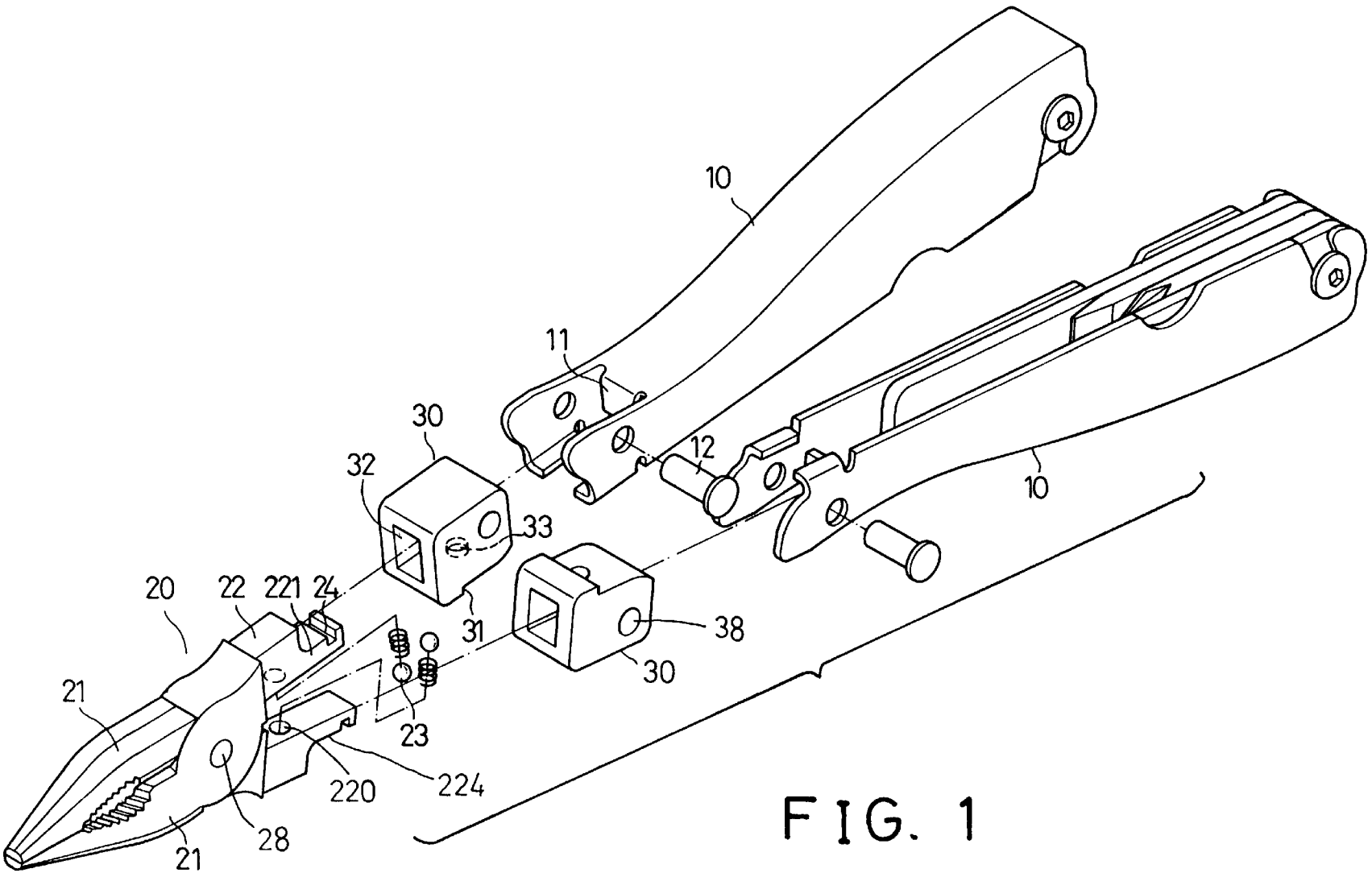
FIG. 1 is an exploded view of a tool in accordance with the present invention.
Figure 2:
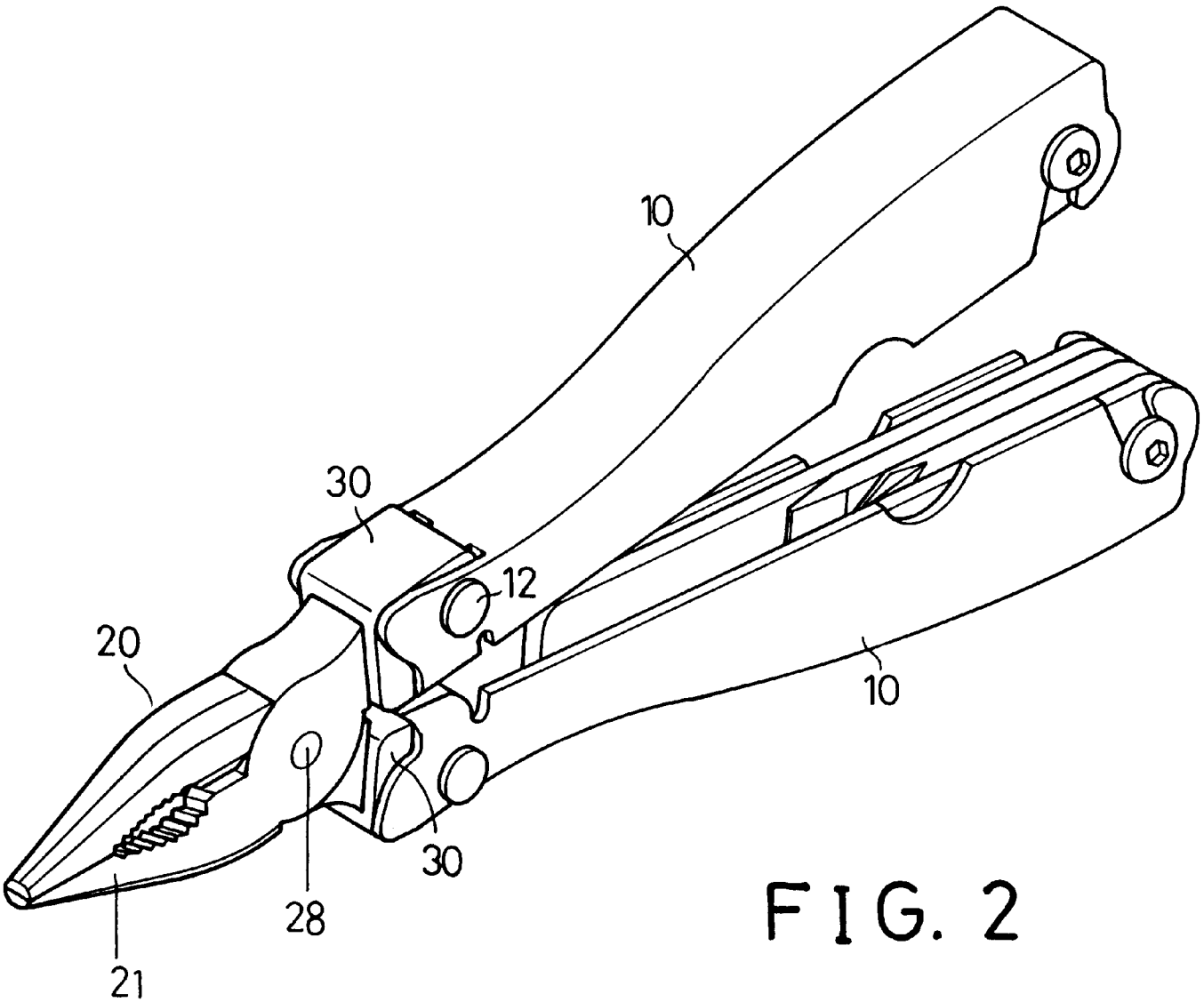
FIG. 2 is a perspective view of the tool.
Figure 3:
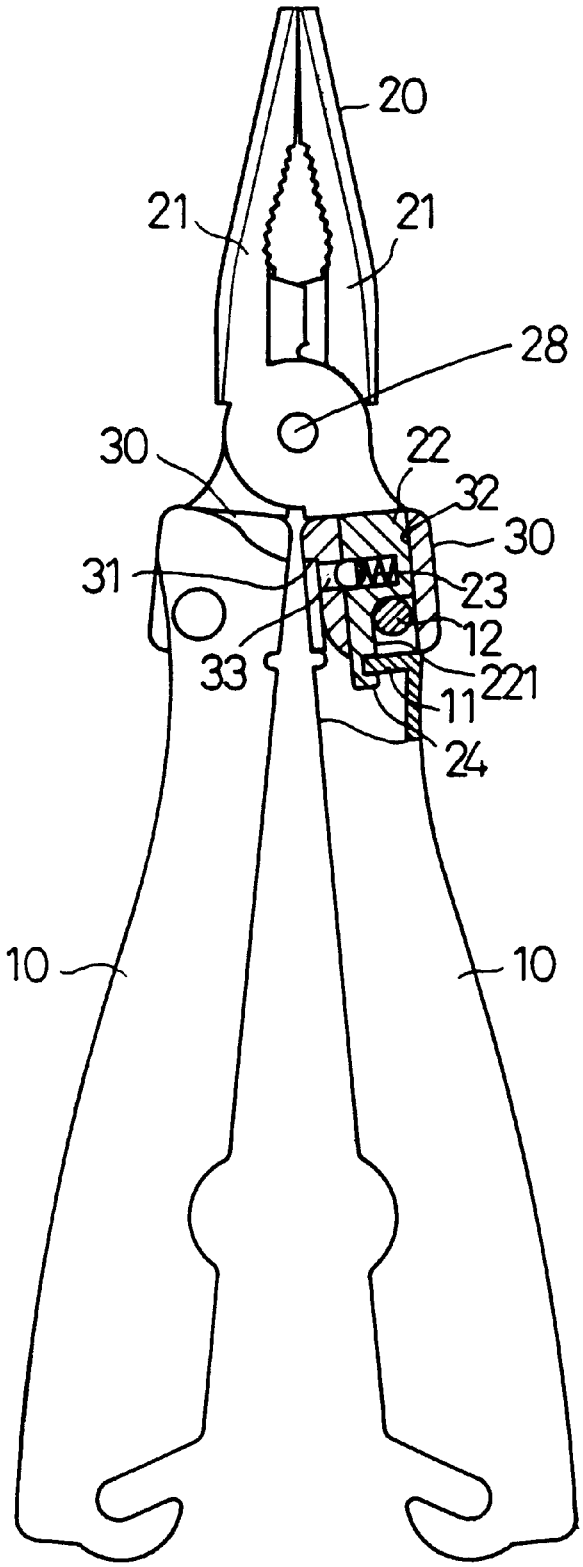
FIGS. 3, 4, 5 are partial cross sectional views illustrating the operation of the tool.

Referring to the drawings, and initially to FIGS. 1–3, a tool combination in accordance with the present invention comprises a pair of handles 10 for attaching to a tool member 20 which includes a pair of tool elements 21 pivotally coupled together at a pivot shaft 28. The tool elements 21 each includes a tool bit formed on one end and an extension 22 extended from the other end thereof. The extensions 22 of the tool elements 21 each includes a hole 220 formed therein for receiving a spring-biased projection 23 and each includes a notch 224 formed therein for defining a leg 221 of a less size than that of the extension 22. The legs 221 each includes a depression 24 formed therein.

A pair of blocks 30 each includes an orifice 32 formed therein for receiving the extensions 22 of the tool elements 21 and each includes a puncture 33 formed therein for receiving the spring-biased projection 23 and for securing the blocks 30 to the tool member 20. The handles 10 each includes one end pivotally coupled to the blocks 30 at a fastener or a pivot pin 12 which is engaged with the notch 224 of the extension 221. The handles 10 each includes a latch 11 extended inward from the one end thereof for engaging with the depression 24 of the leg 221 of the extension 22 (FIG. 3) and for securing the handles 10 to the extensions 22 of the tool member 20. The blocks 30 each includes a shoulder 31 formed therein for engaging with the handles 10 (FIG. 3) and for positioning the handles 10 relative to the tool member 20 at a working position, or for limiting a relative rotational movement of the handle 10 to the block 30.

Figure 4:
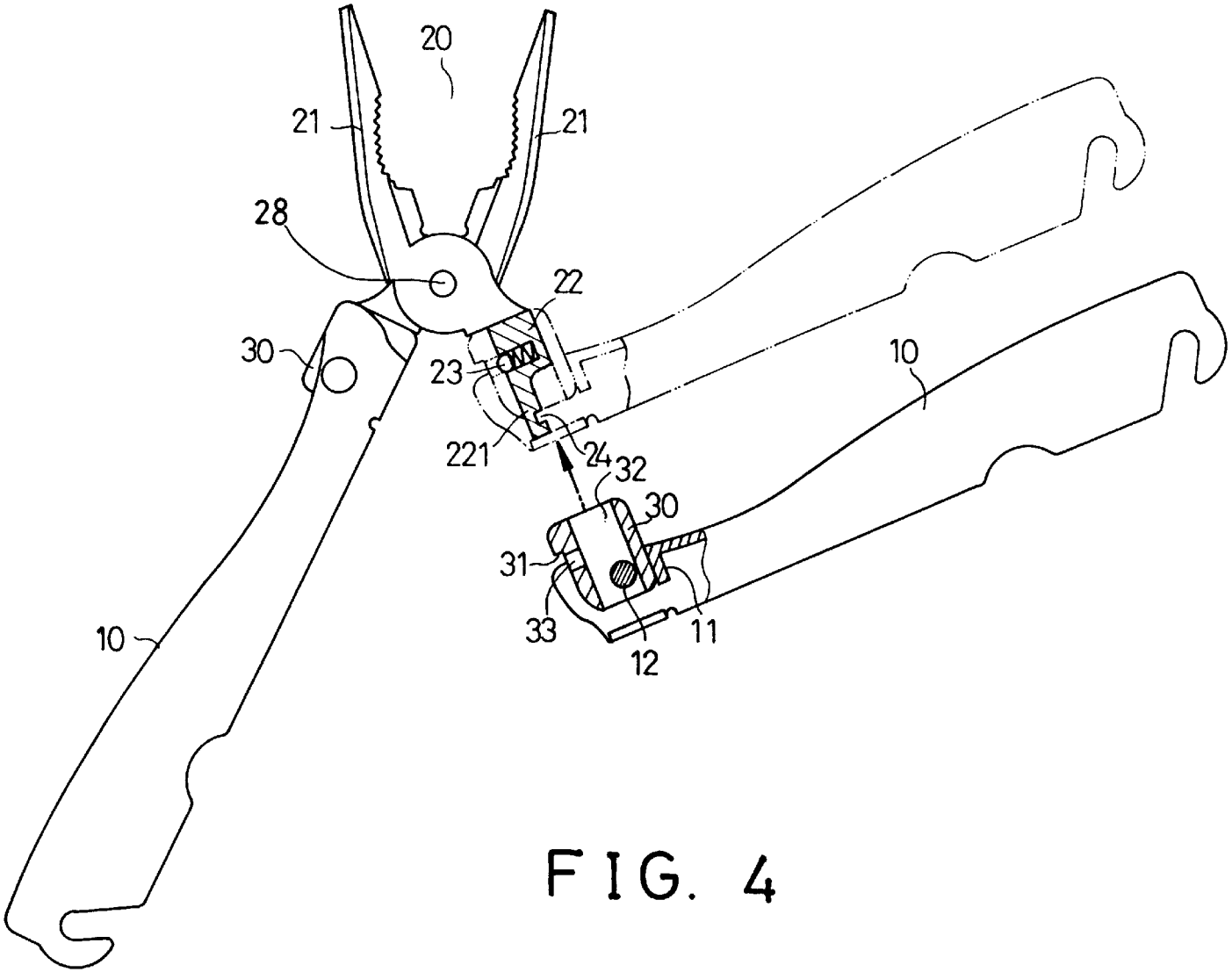
Figure 5:
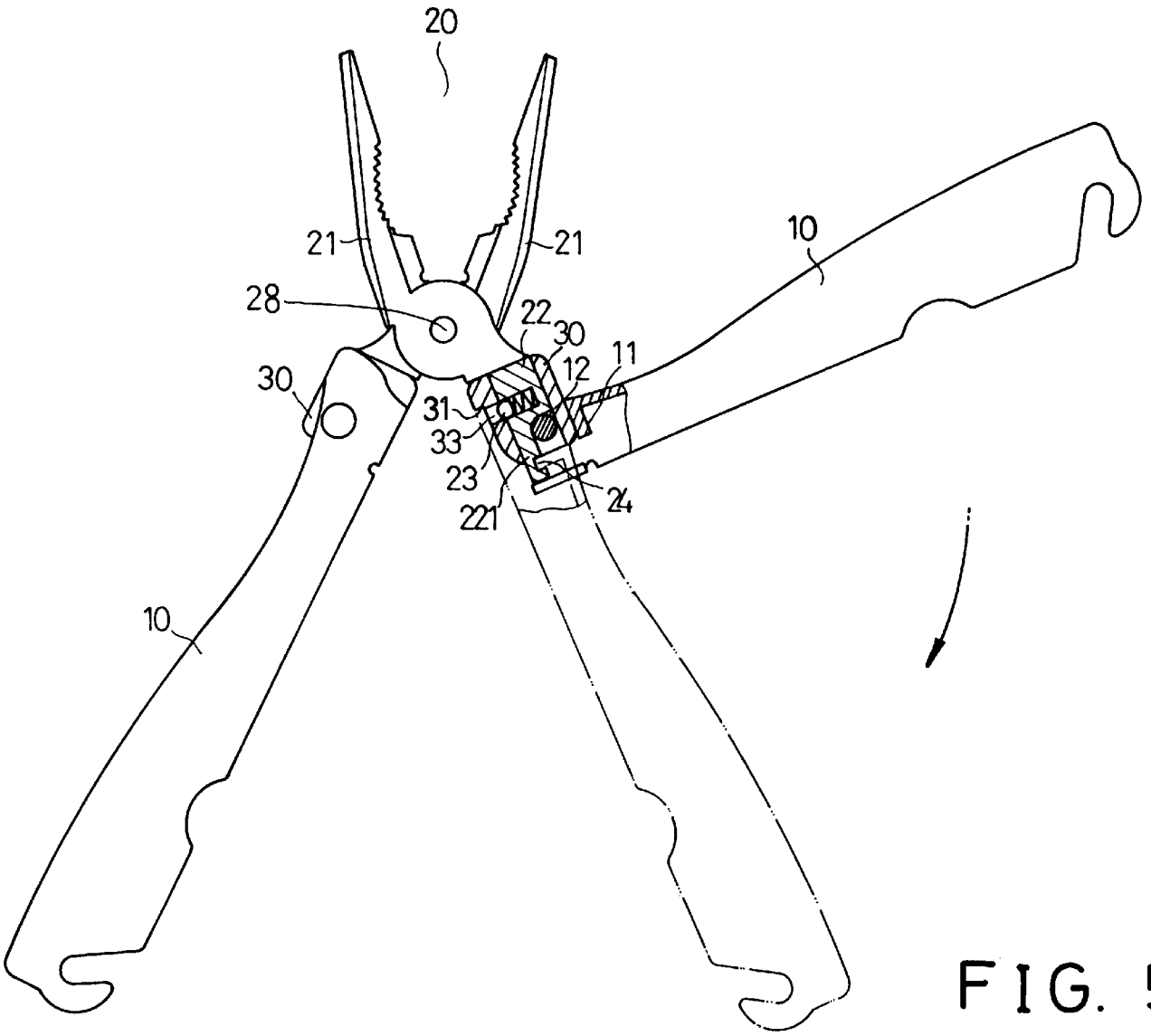

In assembling the handles 10 to the tool member 20, the handle 10 is rotated relative to the block 30 about the pivot pin 12 to a position perpendicular to the block 30, as shown in solid lines of the handle at the right portion of FIG. 4. The extension 22 of the tool member 20 is then engaged into the orifice 32 of the block 30. The handle 10 is then rotated from that shown in solid lines in FIG. 5 to that shown in dotted lines for engaging the latch 11 of the handle 10 into the depression 24 of the leg 221 of the extension 22. The handles 10 may thus be easily and quickly secured to the tool member 20. When the handle 10 is rotated relative to the block 30 for disengaging the latch 11 from the tool extension 22, the extension 22 may be easily disengaged from the handle 10 and the block 30. The tool may include one or more pairs of handles of various sizes for selectively and detachably attached to the tool member 20.

Figure 6:
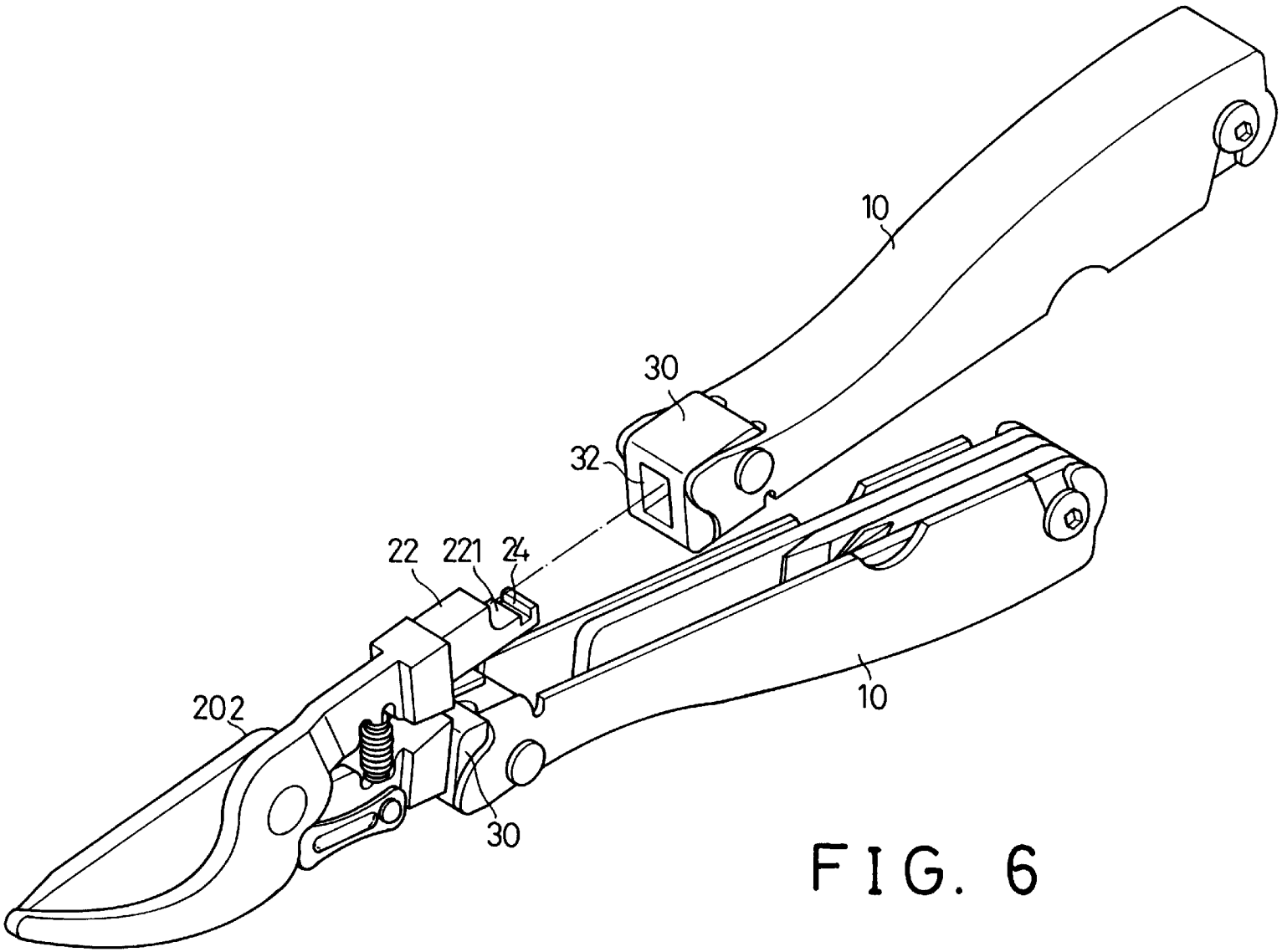
FIGS. 6 and 7 are partial exploded views illustrating the applications of the tool.
Figure 7:
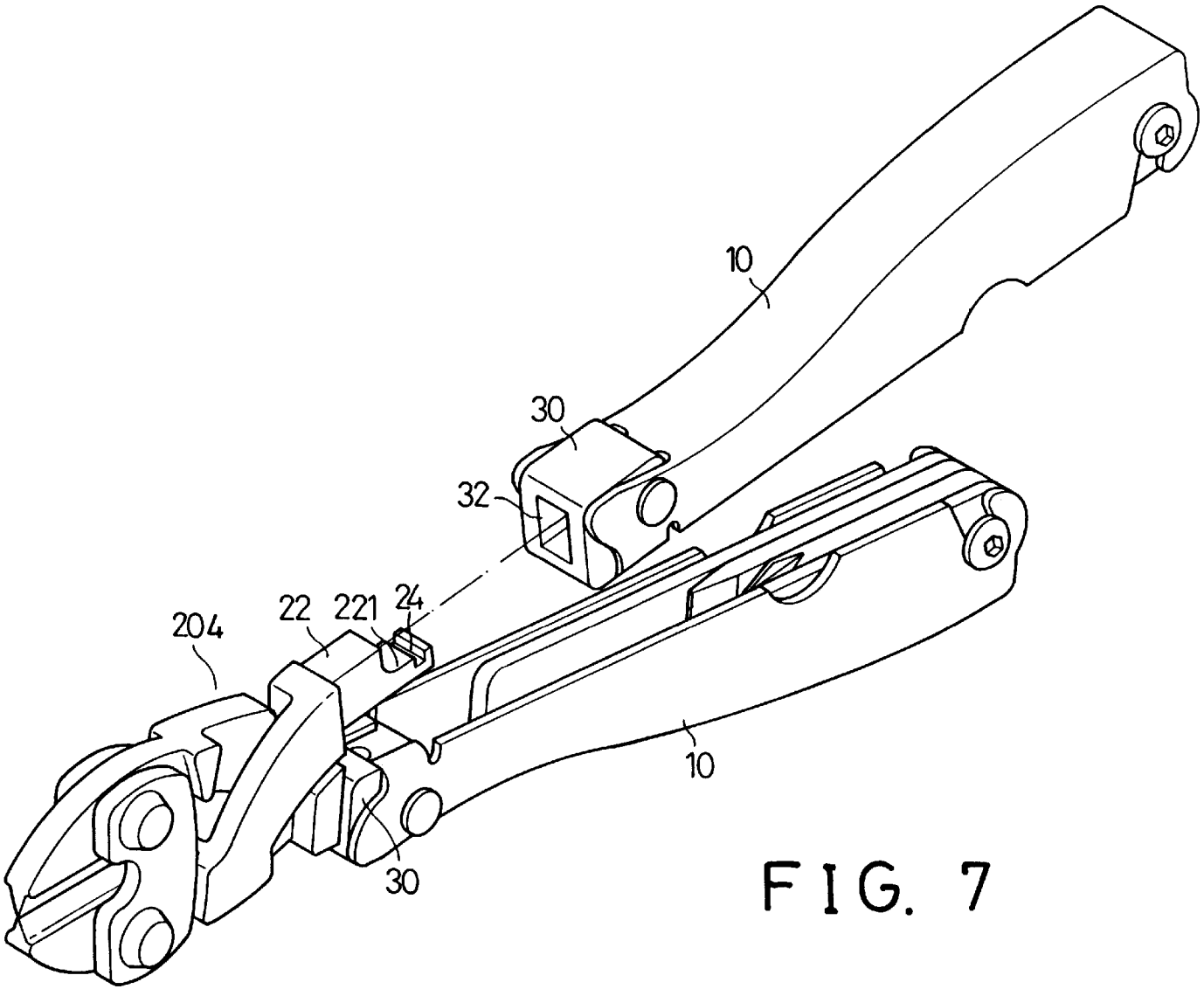

Referring next to FIGS. 6 and 7, the tool combination may include the other types of the tool member, such as the shear types of the tool members 202, 204 for selectively attaching to the handles 10. Alternatively, the tool may include only one of the handles 10 that is detachably attached to the tool member for adjusting only one of the handles.

Accordingly, the tool combination in accordance with the present invention includes a pair of handles that may be detached from the tool members for changing the handles and/or the tool members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a tool member including a pair of tool elements pivotally coupled together at a pivot shaft, at least one of said tool elements including an extension extended therefrom, at least one block including an orifice formed therein for receiving said extension of said at least one of said tool elements, at least one handle including a first end pivotally coupled to said at least one block at a pivot pin, and means for securing said at least one handle to said extension of said at least one of said tool elements.

2. The tool combination according to claim 1 wherein said at least one handle includes a latch means for securing said at least one handle to said extension of said at least one of said tool elements.

3. The tool combination according to claim 1, wherein said extension of said at least one of said tool elements includes a depression formed therein, said at least one handle includes a latch extended inward of said first end thereof for engaging into said depression of said extension and for securing said at least one handle to said extension of said at least one of said tool elements.

4. The tool combination according to claim 1 further comprising means for positioning said extension of said at least one of said tool elements to said at least one block.

5. The tool combination according to claim 1 wherein said extension of said at least one of said tool elements includes a notch formed therein for defining a leg and for receiving said pivot pin.

6. The tool combination according to claim 1 further comprising means for limiting a rotational movement of said at least one handle relative to said at least one block.

* * * * *